US010518319B2

(12) United States Patent
Gerding

(10) Patent No.: US 10,518,319 B2
(45) Date of Patent: Dec. 31, 2019

(54) CHILL BLOCK FOR DIE CAST MACHINE

(71) Applicant: Honda Motor Co., Ltd., Tokyo (JP)

(72) Inventor: Benjamin Gerding, Ottawa, OH (US)

(73) Assignee: Honda Motor Co., Ltd., Tokyo (JP)

( * ) Notice: Subject to any disclaimer, the term of this patent is extended or adjusted under 35 U.S.C. 154(b) by 140 days.

(21) Appl. No.: 15/402,625

(22) Filed: Jan. 10, 2017

(65) Prior Publication Data

US 2018/0193905 A1 Jul. 12, 2018

(51) Int. Cl.
*B22D 15/04* (2006.01)
*B22D 17/20* (2006.01)

(52) U.S. Cl.
CPC ..... *B22D 15/04* (2013.01); *B22D 17/20* (2013.01)

(58) Field of Classification Search
CPC ..... B22D 15/00; B22D 15/02; B22D 15/04
See application file for complete search history.

(56) References Cited

U.S. PATENT DOCUMENTS 4,807,728 A 2/1989 Suenaga et al.
6,425,433 B1 7/2002 Hayes
6,435,258 B1 8/2002 Ogasawara et al.
6,883,583 B2 4/2005 Matsuura et al.
6,955,210 B2 10/2005 Matsuura et al.
7,740,049 B2 6/2010 Sakurai et al.
7,921,901 B2 4/2011 Shin et al.
2007/0122562 A1* 5/2007 Adams ..... B22F 3/1055 427/532

FOREIGN PATENT DOCUMENTS

JP 2005059035 A * 3/2005
WO WO-2014172333 A1 * 10/2014 ..... B22D 17/22

* cited by examiner

*Primary Examiner* — Kevin P Kerns
*Assistant Examiner* — Steven S Ha
(74) *Attorney, Agent, or Firm* — Honda Patents & Technologies North America, LLC; Mark E. Duell

(57) ABSTRACT

A die cast machine includes a die component and a back block supporting the die component, which includes a protrusion, the protrusion having a second cross-sectional shape and a first height. The cross-sectional shape is substantially similar to the cross-sectional shape of the recessed area of the die component, the protrusion being received within the recessed area. The first height of the protrusion is less than the depth of the recessed area. The die cast machine also includes a chill block positioned between the die component and the back block, the chill block having a cross-sectional shape and a second height. The cross-sectional shapes are all substantially similar. A sum of the first height and the second height is substantially similar to the depth of the recessed area.

11 Claims, 8 Drawing Sheets

SECTION A-A

CHILL BLOCK FOR DIE CAST MACHINE

TECHNICAL FIELD

The embodiments disclosed herein are related to the field of die cast machines, and particularly to a chill block for a die cast machine.

BACKGROUND

High-pressure die cast machines typically includes a die component and a permanent back block. Often, a chill block placed between the die component and back block to prevent lateral motion of the die component relative to the back block. The chill block is typically located partially in a recessed portion of the die component and partially in a recessed portion of the back block. The high pressure exerted by the die cast machine, on the order of 3,000 tons, makes it important that the die component and back block are properly aligned. Therefore, the chill block is used as a key to align the die component and back block.

The chill block performs additional die cooling functions. The chill block includes a number of cooling lines that permit the chill block to be used as a manifold for cooling water sent to the die component via a cooling straw and pipe. Due to the physical demands on the chill block, the chill block must be fabricated from an expensive piece of hardened steel that can handle the stress associated with being the key that aligns the die component and the back block. In addition, the cooling lines and inlets/outlets are elaborate and expensive to machine. The cooling lines may be drilled and capped as necessary. Finally, the steel is susceptible to corrosion, resulting in plugging of the cooling lines.

There has been shown a need for a redesigned die cast machine that reduces the physical stresses on the chill block, permitting an improved chill block design that improves the manufacturability and reliability of the chill block as a cooling water manifold.

APPLICATION SUMMARY

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

According to one aspect, a die cast machine having a die cast mold includes a die component, which includes a die surface defining a portion of the die cast mold, and a back surface opposite the die surface, the back surface forming a recessed area having a first cross-sectional shape and a depth. The die cast machine further includes a back block supporting the die component, which includes a protrusion, the protrusion having a second cross-sectional shape and a first height. The second cross-sectional shape is substantially similar to the first cross-sectional shape of the recessed area of the die component, the protrusion being received within the recessed area. The first height of the protrusion is less than the depth of the recessed area. The die cast machine also includes a chill block positioned between the die component and the back block, the chill block having a third cross-sectional shape and a second height. A sum of the first height and the second height is substantially similar to the depth of the recessed area.

According to another aspect, a chill block for a die cast machine having a first cooling channel includes a first block having a first side and a second side, the first block having a coolant inlet and a coolant outlet and a second block having a first side and a second side, the first side being adjacent the second side of the first block, the second block having a first aperture having a first diameter and enabling fluid communication between the first cooling channel and a die cooling channel in the die cast machine, the second block having an outlet aperture aligned with the coolant aperture.

According to yet another aspect, the chill block further includes a second cooling channel and a third block having a first side and a second side, the first side of the third block being adjacent the second side of the second block. The third block includes a second aperture enabling fluid communication between the second cooling channel and the die cooling channel, the second aperture having a second diameter and the second aperture being aligned with the first aperture.

According to still yet another aspect, a die cast machine having a die cast mold includes a die component including a die surface defining a portion of the die cast mold, a back surface opposite the die surface, the back surface comprising a protrusion having a first cross-sectional shape and a first height, and a die cooling channel located in the die component, the die cooling channel having a die opening in the protrusion. The die cast machine further includes a back block supporting the die component including a recessed area, the recessed area having a second cross-sectional shape and a depth. The second cross-sectional shape is substantially similar to the first cross-sectional shape of the protrusion of the die component, the protrusion being received within the recessed area. The first height of the protrusion is less than the depth of the recessed area. The die cast machine further includes a chill block positioned between the die component and the back block, the chill block having a third cross-sectional shape and a second height, the chill block including a cooling channel for circulating a coolant through the chill block in fluid communication with the die cooling channel. A sum of the first height and the second height is substantially similar to the depth of the recessed area.

The figures depict various embodiments of the embodiments for purposes of illustration only. One skilled in the art will readily recognize from the following discussion that alternative embodiments of the structures and methods illustrated herein may be employed without departing from the principles of the embodiments described herein.

DETAILED DESCRIPTION

Figure 1:
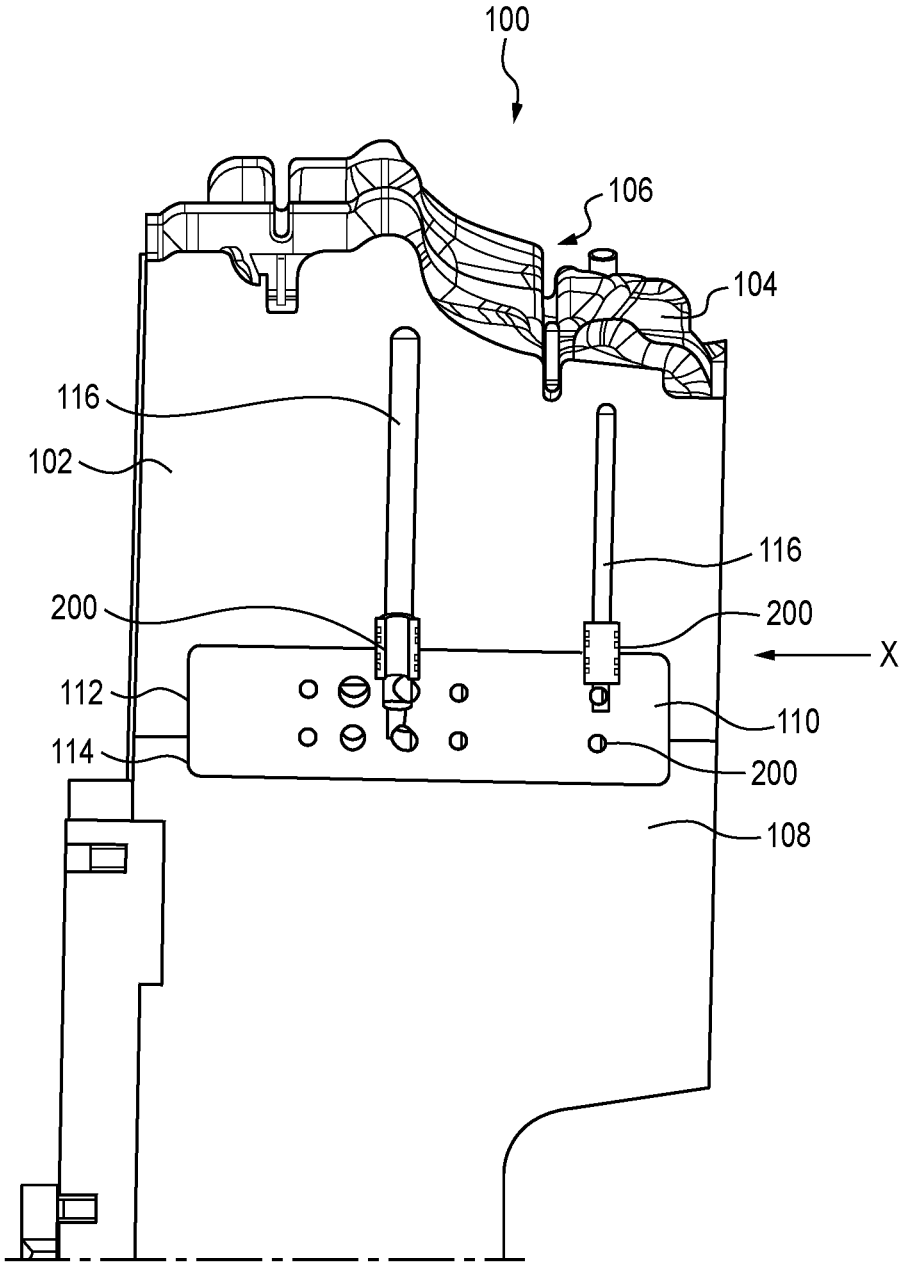
FIG. 1 (PRIOR ART)
FIG. 1 illustrates a portion of a prior art high-pressure die cast machine.

FIG. 1 illustrates a portion of a prior art high-pressure die cast 100. The die cast machine 100 includes a die component 102 that includes a die surface 104 on the front side of the die component 102 that defines a portion of the die cavity or mold 106. Because the die cast machine 100 may be used for the production of multiple products, the die component 102 may be changed to define a new die cavity or mold 106. In order to secure the die component 102 to a permanent back block 108, an intermediate placed chill block 110 is used to secure the die component 102 and prevent lateral motion of the die component 102 relative to the back block 108. The chill block 110 is located partially in a recessed portion 112 of the die component 102 and partially in a recessed portion 114 of the back block 108. The high pressure exerted by the die cast machine 100, along arrow X and on the order of 3,000 tons, makes it important that the die component 102 and back block 108 are properly aligned. Therefore, the chill block 110 is used as a key to align the die component 102 and back block 108.

Figure 2:
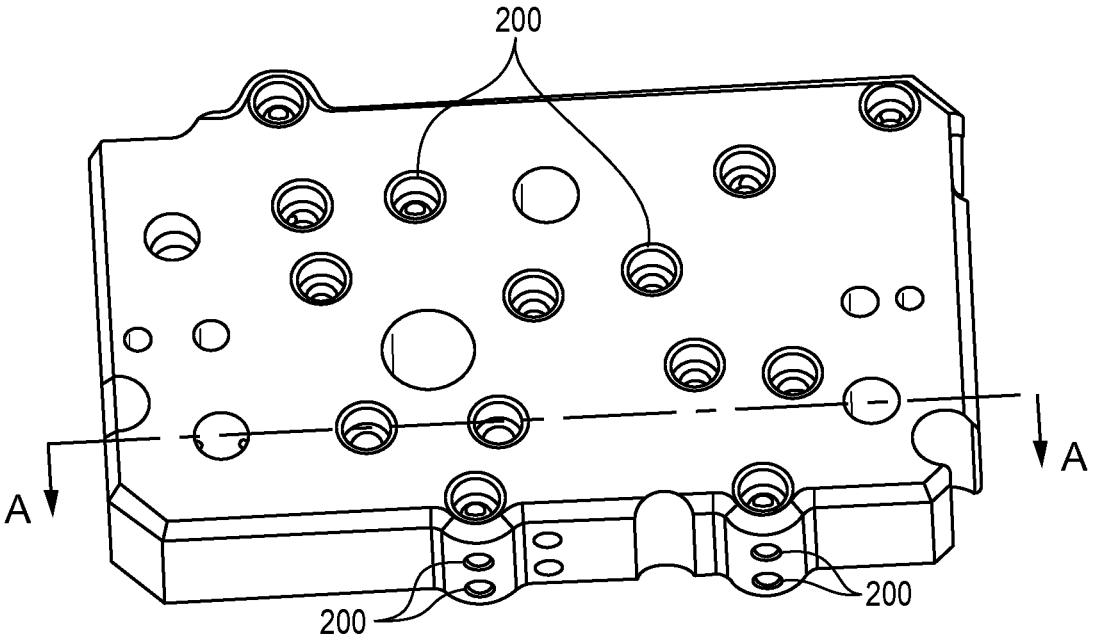
FIG. 2 (PRIOR ART)
FIG. 2 is a top perspective view of a prior art chill block.
Figure 3:
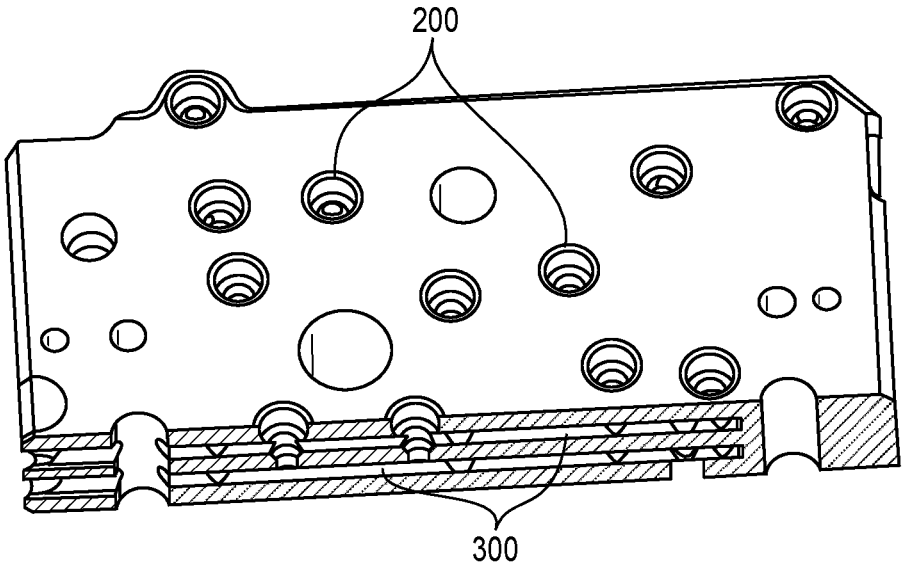
FIG. 3 (PRIOR ART)
FIG. 3 is a cross-sectional view of the prior art chill block taken along line A-A of FIG. 2.

The chill block 110 performs additional functions. As illustrated in FIGS. 2 and 3, the chill block 110 includes a number of cooling lines 300 that permit the chill block 110 to be used as a manifold for cooling water sent to the die component 102 via a cooling straw and pipe 116. Due to the physical demands on the chill block 110, the chill block 110 must be fabricated from an expensive piece of hardened steel that can handle the stress associated with being the key that aligns the die component 102 and the back block 108. In addition, the cooling lines 300 and inlets/outlets 200 are elaborate and expensive to machine. The cooling lines 300 may be drilled and capped as necessary. Finally, the steel is susceptible to corrosion, resulting in plugging of the cooling lines 300.

There has been shown a need for a redesigned die cast machine 100 that reduces the physical stresses on the chill block 110, permitting an improved chill block 110 design the improves the manufacturability and reliability of the chill block 110 as a cooling water manifold.

Figure 4:
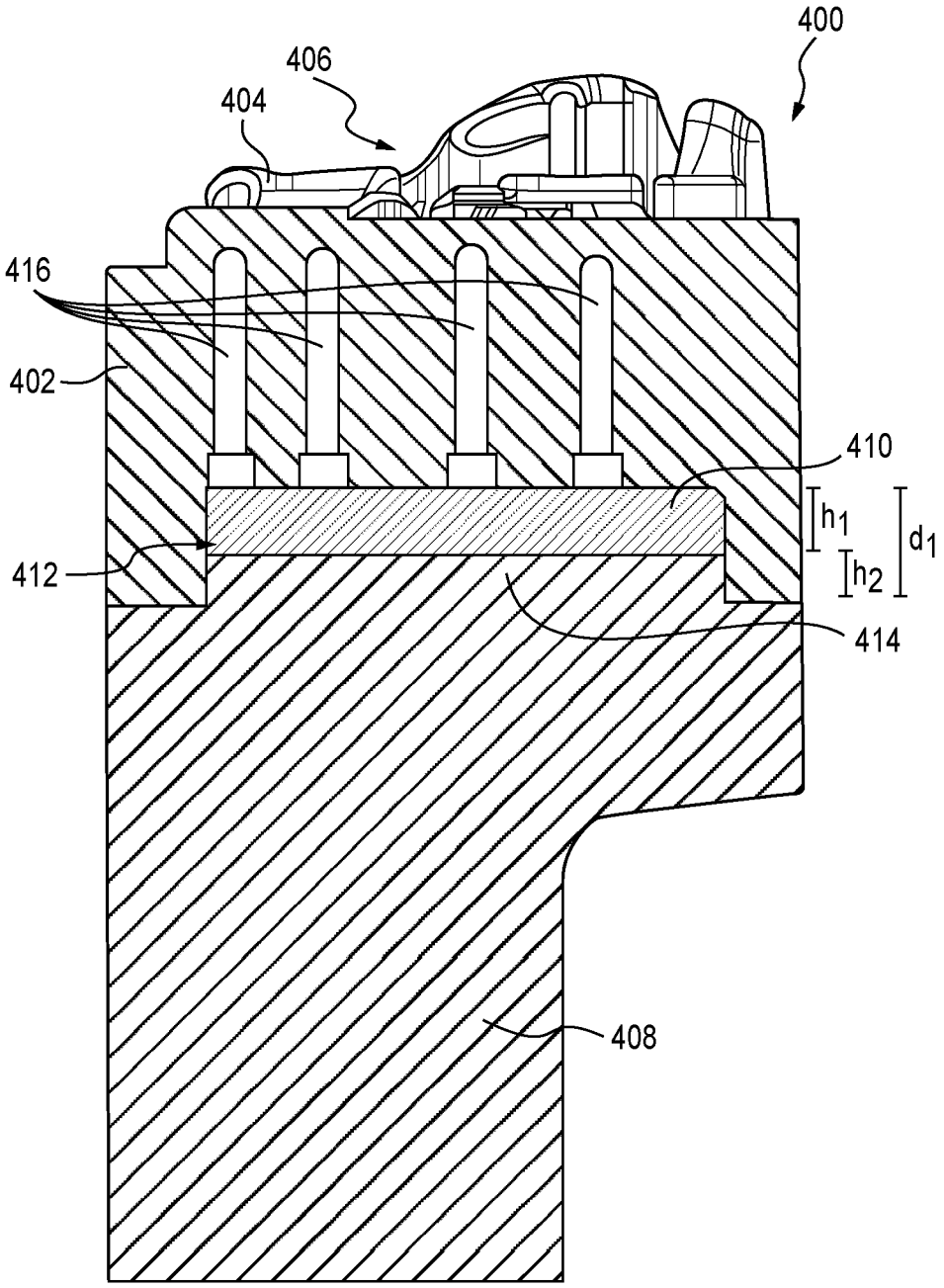
FIG. 4 is a representation of an embodiment of a portion of a high-pressure die cast machine including a cavity design, back block, and chill block.
Figure 6:
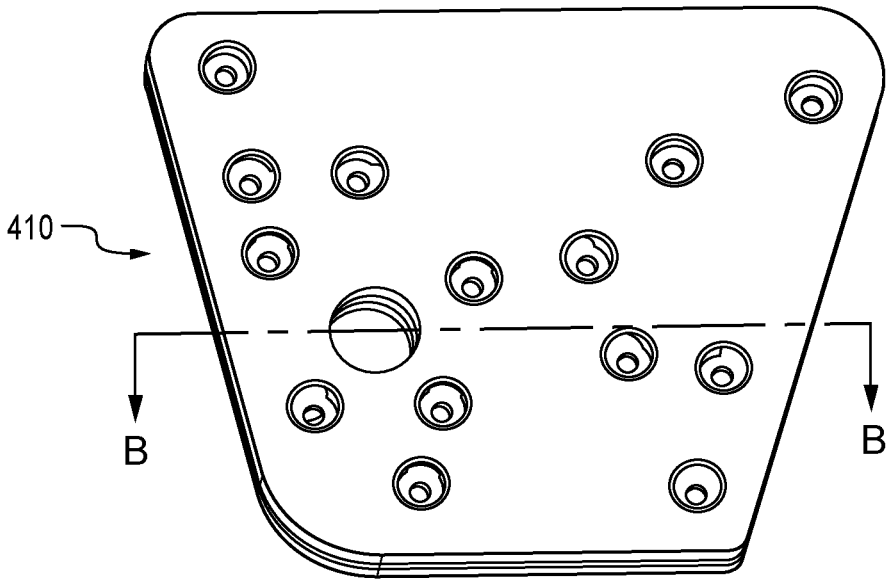
FIG. 6 is a top perspective view of a chill block.
Figure 7:
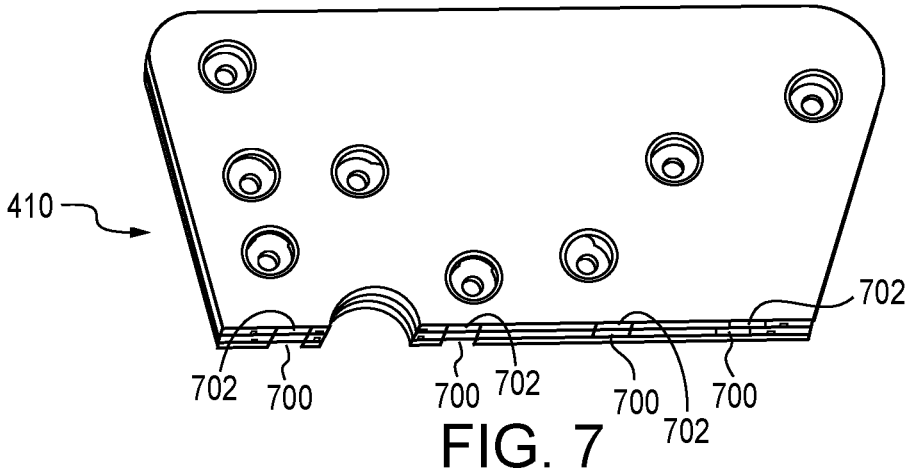
FIG. 7 is a cross-sectional view of the chill block taken along line B-B of FIG. 6.
Figure 8:
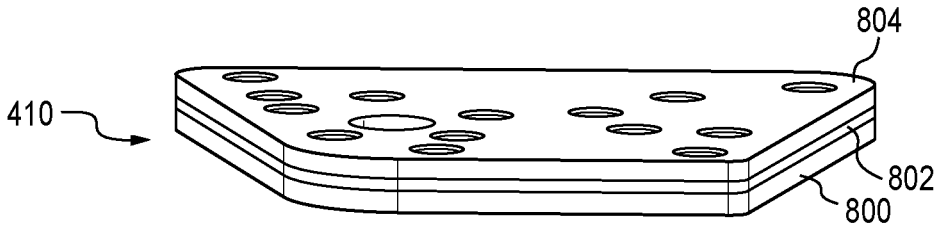
FIG. 8 is a forward perspective view of the chill block.

FIG. 4 illustrates a portion of a new high-pressure die cast machine 400. The die cast machine 400 includes a die component 402 that includes a die surface 404 on the front side of the die component 402 that defines a portion of the die cavity or mold 406. Because the die cast machine 400 may be used for the production of multiple products, the die component 402 may be changed to define a new die cavity or mold 406. a chill block 410 is located within a recessed portion 412 of the die component 402. A protrusion 414 extending upward from the back block 408 also fits into the recessed portion 412 of the die component 402. The cross sectional area of the recessed portion 412, chill block 410, and the protrusion 414 extending upward from the back block 408 all have substantially the same cross-sectional shape so as to fit together. The shape of the cross-section of the recessed portion 412, the chill block 410, and protrusion 414 may be any shape dictated by the geometry of the die cast machine 400. In the embodiment of FIG. 4, the shape is a trapezoid, as illustrated in FIG. 6 showing the chill block 410. The protrusion 414 is used to secure the die component 402 and prevent lateral motion of the die component 402 relative to the back block 408 and maintains the die component 402 and back block 408 in proper alignment. In order to maintain a proper fit, the depth $d_1$ of the recessed portion 412 should be substantially similar, within 1.0-2.0 mm, to the sum of the height $h_1$ of the chill block 410 and the height $h_2$ of the protrusion 414.

The die component 402 may contain at least one, likely a plurality, of die cooling channels 416 extending upward from the recessed area 412 into the die component 402. Coolant, such as water, may be used to cool the die component 402 to extend the life of the die component 402 and ensure the die component 402 operates properly and to solidify the casting in the manner desired. Operation of the die cooling channels 416 is discussed further below.

Figure 5:
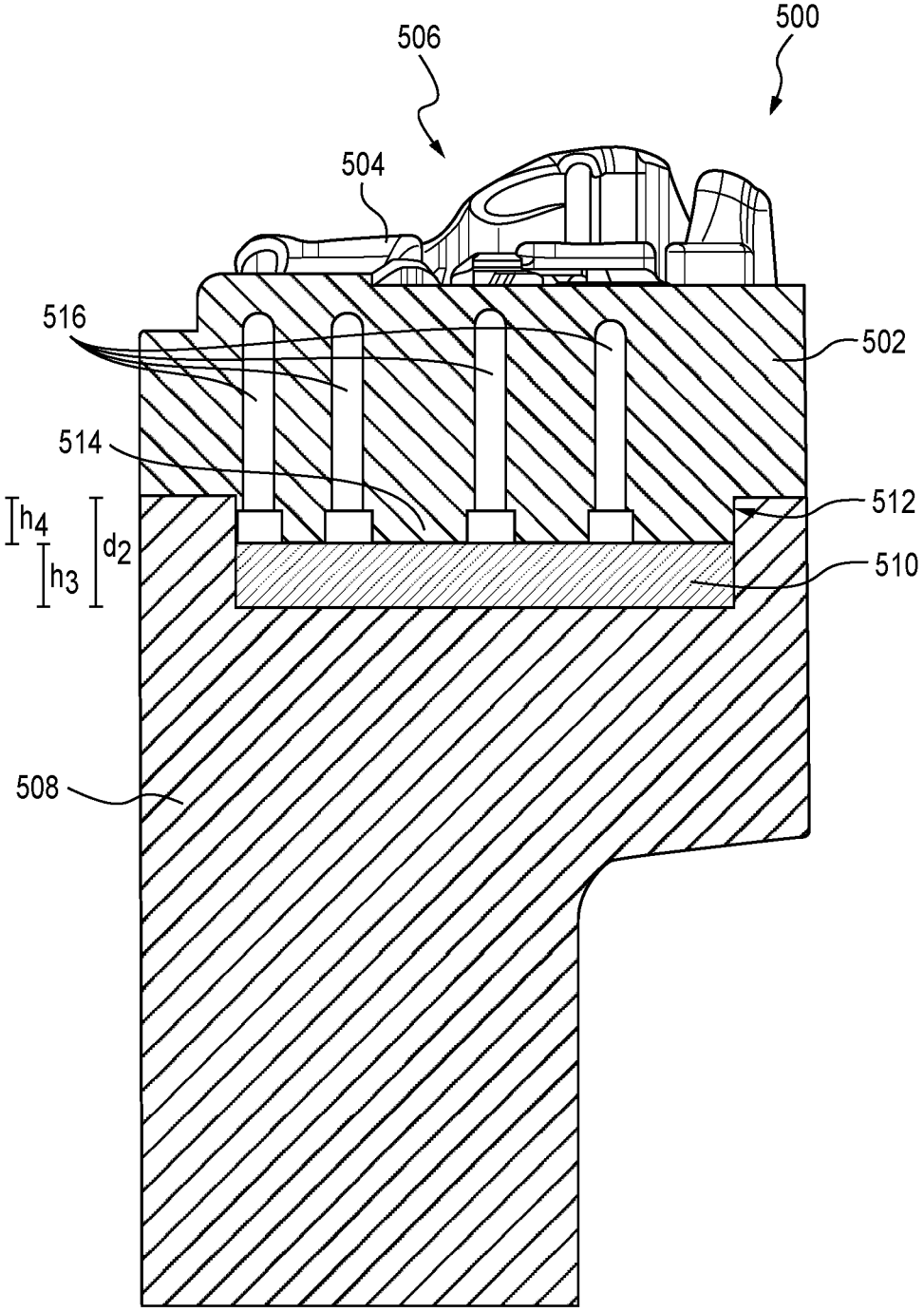
FIG. 5 is a representation of an alternate embodiment of a portion of a high-pressure die cast machine including a cavity design, back block, and chill block.

FIG. 5 illustrates an alternate embodiment of a high-pressure die cast machine 500. The die cast machine 500 includes a die component 502 that includes a die surface 504 on the front side of the die component 502 that defines a portion of the die cavity or mold 506. A protrusion 514 extends downward from the die component 502 and fits into a recessed portion 512 of the back block 508. A chill block 510 is located within a recessed portion 512 of the back block 508. The cross sectional area of the recessed portion 512, chill block 510, and the protrusion 514 extending downward from the die component 502 all have substantially the same cross-sectional shape so as to fit together. The shape of the cross-section of the recessed portion 512, the chill block 510, and protrusion 514 may be any shape dictated by the geometry of the die cast machine. The protrusion 514 is used to secure the die component 502 and prevent lateral motion of the die component 502 relative to the back block 508 and maintains the die component 502 and back block 508 in proper alignment. In order to maintain a proper fit, the depth $d_2$ of the recessed portion 512 should be substantially similar to, within 1.0-2.0 mm, the sum of the height $h_3$ of the chill block 510 and the height $h_4$ of the protrusion 514.

Referring to the embodiment of the high-pressure die cast machine 400 illustrated in FIG. 4, FIGS. 6-12 illustrate an embodiment of the chill block 410. As illustrated in the FIG. 6, the chill block 410 is trapezoidal in shape, although the shape may be tailored to the geometry of the die cast machine 400. As illustrated is FIG. 7, which is a cross-section taken along line B-B of FIG. 6, and in FIG. 8 a first cooling channel 700 is located in a first block 800 and a second cooling channel 702 is located in a third block 804 of the chill block 410. A second block 802 is located in between the first block 800 and the third block 804.

Figure 9:
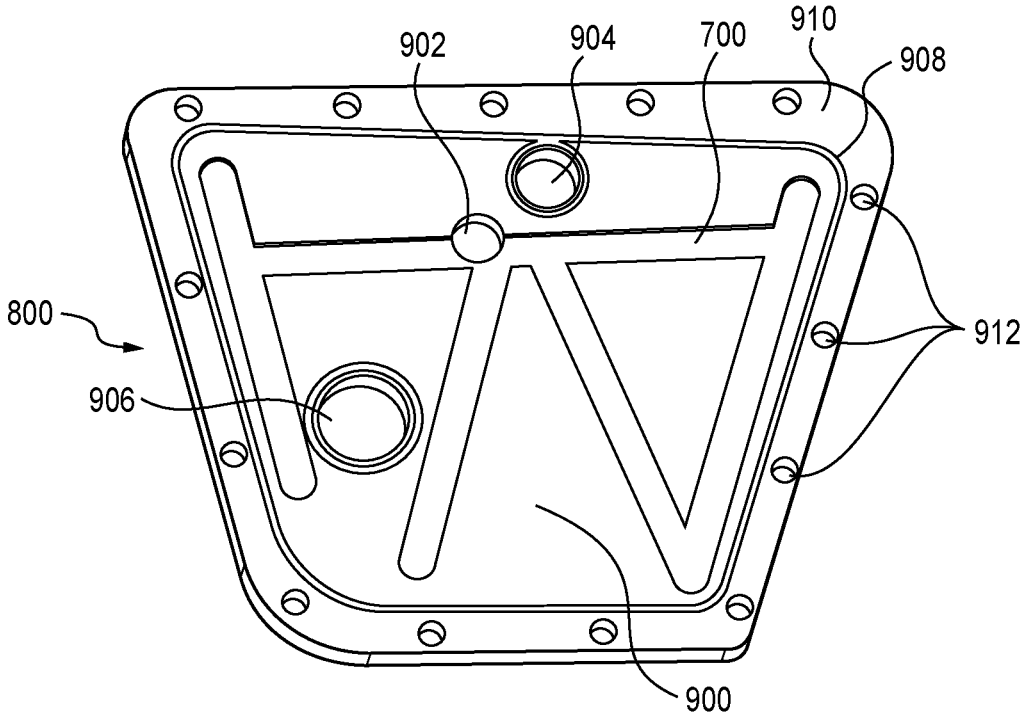
FIG. 9 is a top view of a first block of the chill block.

FIG. 9 illustrates the first block 800 of the chill block 410 in greater detail. The first cooling channel 700 is formed, such as by milling or any other appropriate method, into an inner surface 900 of the first block 800. A water inlet 902 is also formed into first cooling channel 700 in the first block 800. Water, or any other suitable coolant or fluid, is supplied to the chill block 410 through the water inlet 902 and distributed through the first cooling channel 700. A water outlet 904 is also located in the first block 800. The water outlet is not in fluid communication with the first cooling channel 700, but rather is in fluid communication with the second cooling channel 702. The first block further contains an alignment hole 906 that aligns with a pin (not shown)

located within either the die component 402 or back block 408. The first block 800 may also contain an O-ring seal or gasket 908 around an outer edge 910 for providing a seal when the second block 802 is attached to the first block 800. The first block 800 may also include a plurality of holes 912 for receiving any suitable fasteners, such as bolts, for attaching the first block 800, second block 802, and third block 804 together.

Figure 10:
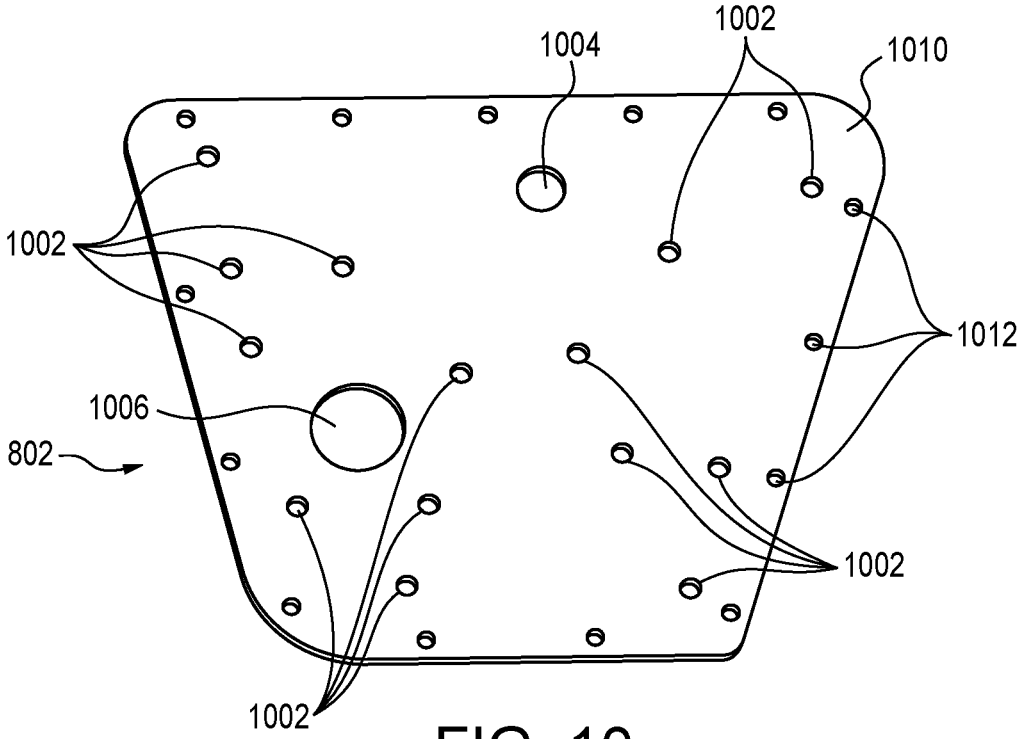
FIG. 10 is a top view of a second block of the chill block.

FIG. 10 illustrates the second block 802 of the chill block 410. The second block 802 is preferably flat on both sides with a number of holes formed there through. An alignment hole 1006 is aligned with the alignment hole 906 in the first block 800. A water outlet aperture 1004 is aligned with the water outlet 904 in the first block, allowing water to pass from the second cooling channel 702, through the water outlet aperture 1004, and into the water outlet 904 and out of the chill block 410. A plurality of apertures 1002 are formed into second block 802 that are aligned with the first cooling channel 700 in the first block 800. The apertures 1002 permit fluid communication with die cooling channels 416 located in the die component 402, as illustrated in FIG. 4. The second block 802 may further contain a plurality of holes 1012 located around an outer edge 1010 of the second block 802 for receiving any suitable fasteners, such as bolts, for attaching the first block 800, second block 802, and third block 804 together.

Figure 11:
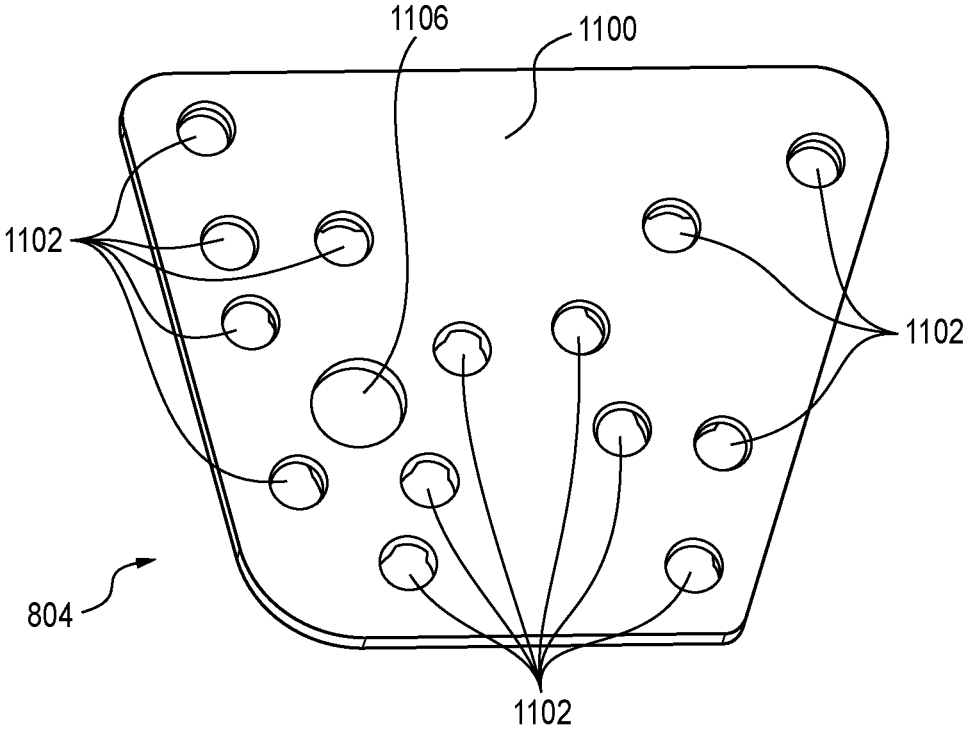
FIG. 11 is a top view of a third block of the chill block.
Figure 12:
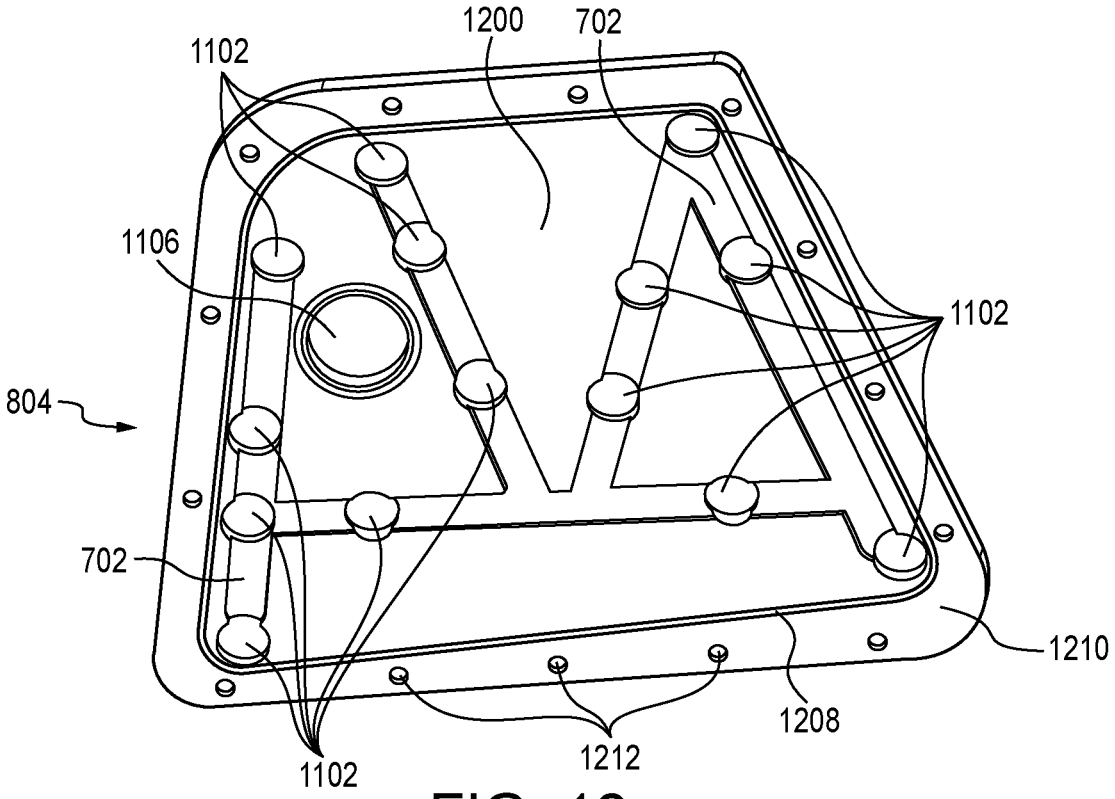
FIG. 12 is a bottom view of a third block of the chill block.

FIGS. 11-12 illustrate the third block 804 of the chill block 410 in greater detail. FIG. 11 illustrates the outer surface 1100 of the third block 804, and FIG. 12 illustrates an inner surface 1200 of the third block 804. The second cooling channel 702 is formed into the inner surface 1200 of the third block 804. Water, or any other suitable coolant or fluid, returns to the chill block 410 through the larger apertures 1102 and flows through the second cooling channel 702. Water flows through a water outlet aperture 1004 in the second block 802, which is aligned and in fluid communication with the second cooling channel 702, and then exits the water outlet 904 located in the first block 800. The third block 804 further contains an alignment hole 1106 that aligns with a pin (not shown) located within either the die component 402 or back block 408. The third block 804 may also contain an O-ring seal or gasket 1208 around an outer edge 1210 of the inner surface 1200 for providing a seal when the second block 802 is attached to the third block 804. The third block 804 may also include a plurality of holes 1212 for receiving any suitable fasteners, such as bolts, for attaching the first block 800, second block 802, and third block 804 together.

Figure 13:
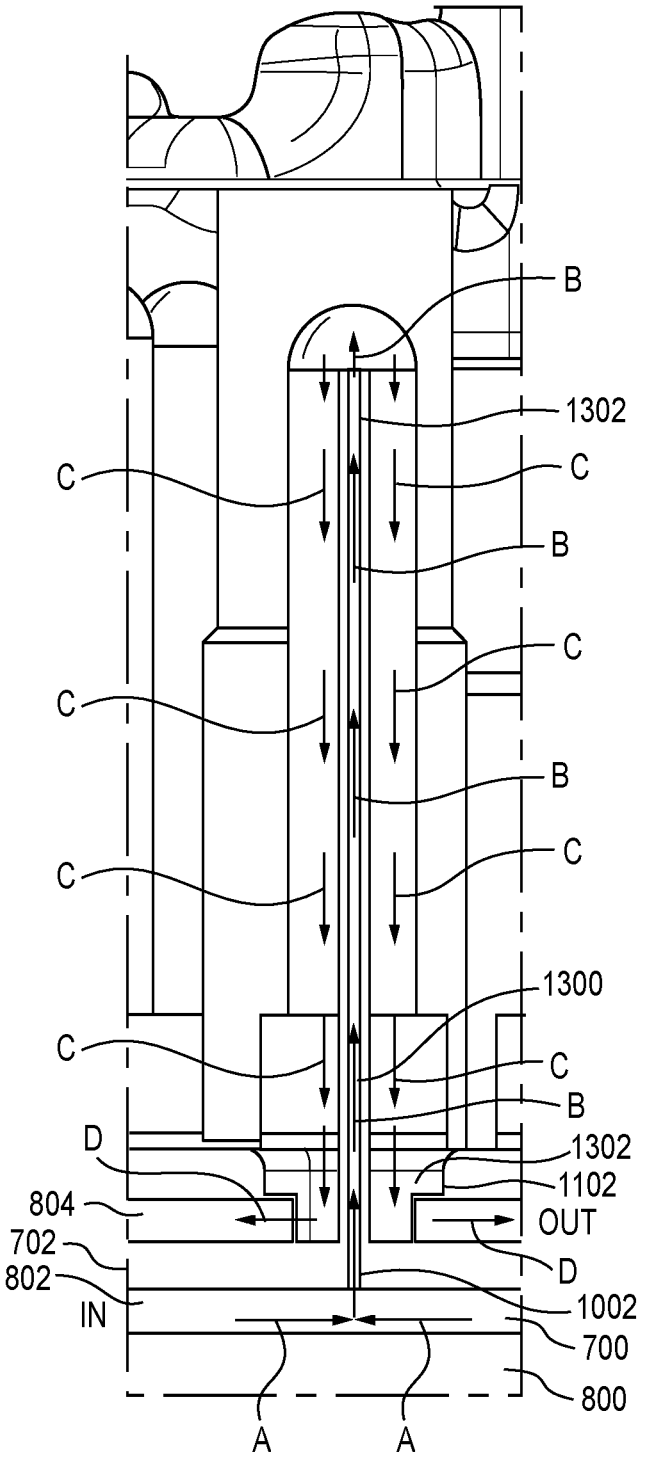
FIG. 13 is a representation of an embodiment of a die cooling channel of the high-pressure die cast machine and a portion of the chill block.

FIG. 13, which is an illustration of a portion of the chill block 410 and a die cooling channel 416, illustrates the flow of water, or any other suitable coolant, though one of a plurality of die cooling channels 416 to cool the die component 402. Water flows in the direction of arrow A through the first cooling channel 700 in the first block 800. A straw 1300 is inserted into the aperture 1002 in the second block 802, which forms the top of the first cooling channel 700. The diameter of the straw 1300 is approximately equal the diameter of the aperture 1002, creating a tight fit. The straw 1300 also extends through a cap and seal 1302 located in the larger aperture 1102 of the third block 804 aligned with the aperture 1002 of the second block 802. The water, under pressure, flows up the straw 1300 in the direction of arrow B, which is also inserted into the die cooling channel 416. As water enters the die cooling channel 416 from the distal end 1302 of the straw 1300, through the process of heat exchange, the water draws heat from the die component 402. The water continues to flow, along the direction of arrow C down the die cooling channel 416. Water flows through the cap and seal 1302 in larger aperture 1102 into the second cooling channel 702. Water flows along arrow D through the water outlet aperture 1004 in the second block 802, which is aligned and in fluid communication with the second cooling channel 702, and then exits the water outlet 904 located in the first block 800 as previously illustrated.

The first block 800, second block 802, and third block 804 may be constructed of any suitable materials that can manage the temperatures involved in the cooling of the die cast machine 400 and are not susceptible to corrosion when subjected to water or any other coolant that is used. The materials may be steel, stainless steel, aluminum, thermoplastics, or any other suitable material known to those skilled in the art.

In alternate embodiments, either or both the first cooling channel 700 and second cooling channel 702 may be formed in the second block 802 instead of the first block 800 and third block 804 respectively. Additionally, the third block 804 may be eliminated in some applications where coolant flow may be controlled by other methods known to those skilled in the art.

Reference in the specification to "one embodiment" or to "an embodiment" means that a particular feature, structure, or characteristic described in connection with the embodiments is included in at least one embodiment. The appearances of the phrase "in one embodiment" or "an embodiment" in various places in the specification are not necessarily all referring to the same embodiment.

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments, which is set forth in the claims.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses of the embodiments without departing from the spirit and scope of the embodiments as defined in the appended claims.

What is claimed is:

1. A die cast machine having a die cast mold, comprising:

a die component, the die component comprising:

a die surface defining a portion of the die cast mold; and a back surface opposite the die surface, the back surface comprising a recessed area having a first cross-sectional shape and a depth;

a back block supporting the die component, the back block comprising:

a protrusion, the protrusion having a second cross-sectional shape and a first height;

wherein the second cross-sectional shape is substantially similar to the first cross-sectional shape of the recessed area of the die component, the protrusion being received within the recessed area; and wherein the first height of the protrusion is less than the depth of the recessed area;

a chill block positioned between the die component and the back block, the chill block having a third cross-sectional shape and a second height; and wherein a sum of the first height and the second height is substantially equal to the depth of the recessed area.

2. The die cast machine of claim 1 wherein the chill block further comprises:

a cooling channel for circulating a coolant through the chill block.

3. The die cast machine of claim 2 wherein the die component further comprises:

a die cooling channel, the die cooling channel being in fluid communication with the cooling channel in the chill block.

4. The die cast machine of claim 3 wherein the third cross-sectional shape is substantially similar to the first and second cross-sectional shapes.

5. The die cast machine of claim 4 wherein the chill block further comprises:

a first block having a first side and a second side, a first portion of the cooling channel being formed into the second side, the first block having a coolant inlet in the first portion of the cooling channel and a coolant outlet; and a second block having a first side and a second side, the first side being adjacent the second side of the first block, the second block having a first aperture having a first diameter and enabling fluid communication between the first portion of the cooling channel and the die cooling channel, the second block having an outlet aperture aligned with the coolant outlet.

6. The die cast machine of claim 5 wherein the chill block further comprises:

a third block having a first side and a second side, the first side of the third block being adjacent the second side of the second block, the third block comprising:

a second portion of the cooling channel formed in the first side of the third block; and a second aperture enabling fluid communication between the second portion of the cooling channel and the die cooling channel, the second aperture having a second diameter and the second aperture being aligned with the first aperture.

7. The die cast machine of claim 6 further comprising:

a seal inserted in the second aperture to provide a seal between the die cooling channel and the chill block.

8. The die cast machine of claim 7 further comprising:

a cooling straw having a third diameter, the third diameter being substantially the same as the first diameter and less than the second diameter, the cooling straw inserted through the second aperture and into the first aperture.

9. The die cast machine of claim 8 wherein coolant flows through the coolant inlet into the first portion of the cooling channel, into the cooling straw, into the die cooling channel, into the second portion of the cooling channel, and out the coolant outlet.

10. The die cast machine of claim 6 wherein the chill block is comprised of a thermoplastic, aluminum, steel, or stainless steel.

11. A die cast machine having a die cast mold, comprising:

a die component, the die component comprising:

a die surface defining a portion of the die cast mold;

a back surface opposite the die surface, the back surface comprising a protrusion having a first cross-sectional shape and a first height; and a die cooling channel located in the die component, the die cooling channel having a die opening in the protrusion;

a back block supporting the die component, the back block comprising:

a recessed area, the recessed area having a second cross-sectional shape and a depth;

wherein the second cross-sectional shape is substantially similar to the first cross-sectional shape of the protrusion of the die component, the protrusion being received within the recessed area; and wherein the first height of the protrusion is less than the depth of the recessed area; and a chill block positioned between the die component and the back block, the chill block having a third cross-sectional shape and a second height, the chill block comprising:

a cooling channel for circulating a coolant through the chill block in fluid communication with the die cooling channel; and wherein a sum of the first height and the second height is substantially similar to the depth of the recessed area.

* * * * *